US009205650B2

(12) United States Patent
Yaginuma et al.

(10) Patent No.: US 9,205,650 B2
(45) Date of Patent: Dec. 8, 2015

(54) LIQUID EJECTION HEAD

(71) Applicant: CANON KABUSHIKI KAISHA, Tokyo (JP)

(72) Inventors: Seiichiro Yaginuma, Kawasaki (JP); Kazuhiro Asai, Kawasaki (JP); Kenji Fujii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/553,765

(22) Filed: Nov. 25, 2014

(65) Prior Publication Data

US 2015/0151543 A1 Jun. 4, 2015

(30) Foreign Application Priority Data

Nov. 29, 2013 (JP) ..... 2013-248451

(51) Int. Cl.
*B41J 2/14* (2006.01)
*B41J 2/16* (2006.01)

(52) U.S. Cl.
CPC ..... *B41J 2/1404* (2013.01); *B41J 2/1433* (2013.01); *B41J 2/1603* (2013.01); *B41J 2/164* (2013.01); *B41J 2/1628* (2013.01)

(58) Field of Classification Search
CPC ..... B41J 2/162; B41J 2/1631; B41J 2/139; B41J 2/135; B41J 2/14016; B41J 2/1404; B41J 2/1408; B41J 2/1433
See application file for complete search history.

(56) References Cited

U.S. PATENT DOCUMENTS

2004/0036744 A1 * 2/2004 Cho et al. ..... 347/65

FOREIGN PATENT DOCUMENTS

JP 2005205916 A 8/2005

* cited by examiner

*Primary Examiner* — Geoffrey Mruk
(74) *Attorney, Agent, or Firm* — Canon U.S.A. Inc., IP Division

(57) ABSTRACT

A liquid ejection head includes a substrate and a channel wall member on a surface of the substrate. The channel wall member serves as a wall of a channel through which a liquid flows. The channel wall member comprises a photosensitive resin. The channel wall member includes a first region and a second region that are arranged in a direction parallel to the surface of the substrate. The first region of the channel wall member has a higher crosslink density than the second region of the channel wall member.

11 Claims, 10 Drawing Sheets

LIQUID EJECTION HEAD

BACKGROUND OF THE INVENTION

1. Field of the Invention

The present invention relates to a liquid ejection head.

2. Description of the Related Art

A liquid ejection head is included in a liquid ejecting apparatus such as an ink jet recording apparatus. A liquid ejection head includes a channel wall member and a substrate. In Japanese Patent Laid-Open No. 2005-205916, a liquid ejection head including a channel wall member formed on a substrate is described.

The channel wall member comprises a resin, in particular, a photosensitive resin. The channel wall member serves as the wall of a channel through which a liquid flows. In some cases, liquid ejection ports are formed in the channel wall member. Generally, the substrate is a silicon substrate composed of silicon. A supply port through which a liquid is supplied is formed in the substrate. Energy generating devices are disposed on the upper surface of the substrate. A liquid is supplied through the liquid supply port into the channel, energized by the energy generating devices, and thereby ejected from the liquid ejection ports onto a record medium such as paper.

SUMMARY OF THE INVENTION

Aspects of the present invention provide a liquid ejection head including a substrate and a channel wall member formed on the surface of the substrate, the channel wall member comprising a photosensitive resin. The channel wall member has a first region and a second region that are arranged in a direction parallel to the surface of the substrate. The crosslink density of the first region is lower than that of the second region.

Further features of the present invention will become apparent from the following description of exemplary embodiments with reference to the attached drawings.

DESCRIPTION OF THE EMBODIMENTS

Generally, a substrate and a channel wall member have different coefficients of linear expansion. The difference in coefficients of linear expansion causes a stress in the substrate due to, for example, an environmental change that occurred during the manufacturing process. According to studies conducted by the inventors of the present invention, in the liquid ejection head described in Japanese Patent Laid-Open No. 2005-205916, the channel wall member might be removed from the substrate due to a stress that was applied to the substrate. Furthermore, the shape of liquid ejection ports might be deformed, which affected the direction in which a liquid was ejected. Removal of the channel wall member from the substrate is caused by deformation of the substrate or deformation of the channel wall member.

Accordingly, aspects of the present invention provide a liquid ejection head in which a channel wall member is less likely to be removed from a substrate.

An embodiment of the present invention is described below.

Figure 1:
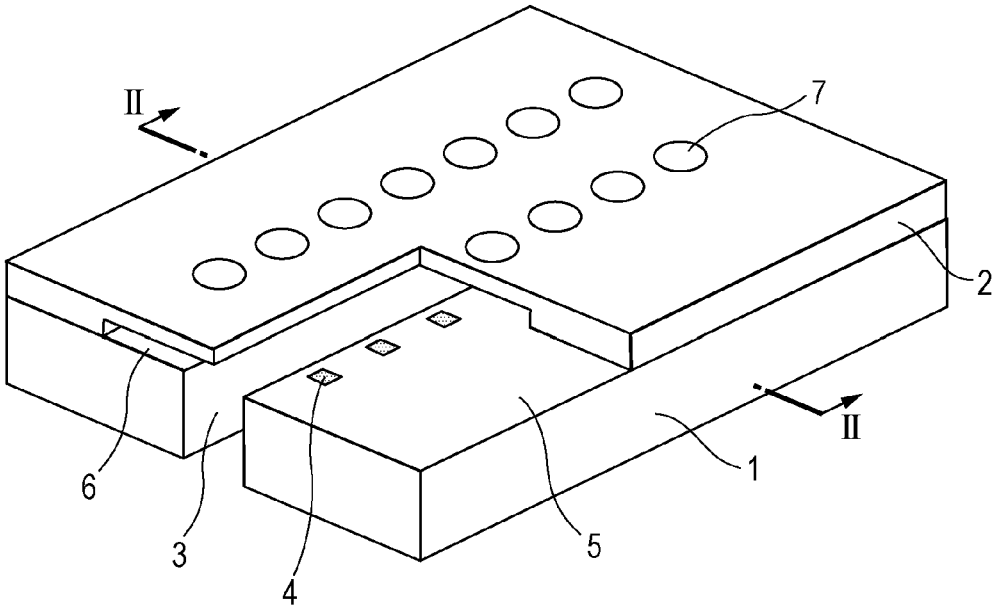
FIG. 1 is a diagram illustrating an example of a liquid ejection head according to an embodiment of the present invention.

FIG. 1 is a diagram illustrating an example of the liquid ejection head according to the embodiment. The liquid ejection head includes a substrate 1 and a channel wall member 2 formed on the surface of the substrate 1.

The substrate 1 is composed of, for example, Si, Ge, SiC, GaAs, InAs, GaP, diamond, ZnO that is an oxide semiconductor, InN and GaN that are nitride semiconductors, a mixture of these materials, or an organic semiconductor. Alternatively, the substrate 1 may be a substrate composed of glass, $Al_2O_3$, a resin, or a metal on which a circuit including a thin-film transistor or the like is formed. An SOI substrate or the like may also be used as the substrate 1. In particular, the substrate 1 is preferably a silicon substrate composed of Si. A liquid supply port 3 is formed in the substrate 1. In the liquid supply port 3, a beam and a filter for a channel may be disposed.

Energy generating devices 4 and connection terminals (not shown) are formed on the surface 5 of the substrate 1. Examples of an element that can be used as the energy generating devices 4 include a resistance heating element and an electromagnetic heating element that use thermal energy, a piezoelectric element and an ultrasonic element that use mechanical energy, and an element that ejects a liquid using electric energy or magnetic energy. The energy generating devices 4 may be disposed so as to be in contact with the surface of the substrate 1. A part of each energy generating device 4 may be hollow. The energy generating devices 4 may be covered with an insulation layer or a protective layer.

A channel wall member 2, which serves as the wall of a channel through which a liquid flows, is formed on the surface 5 of the substrate 1. The channel wall member 2 comprises a photosensitive resin. Examples of the photosensitive resin includes a negative photosensitive resin and a positive photosensitive resin. In particular, the channel wall member 2 is preferably composed of a negative photosensitive resin. A liquid flow passage 6 and liquid ejection ports 7 are formed in the channel wall member 2.

Figure 2A:
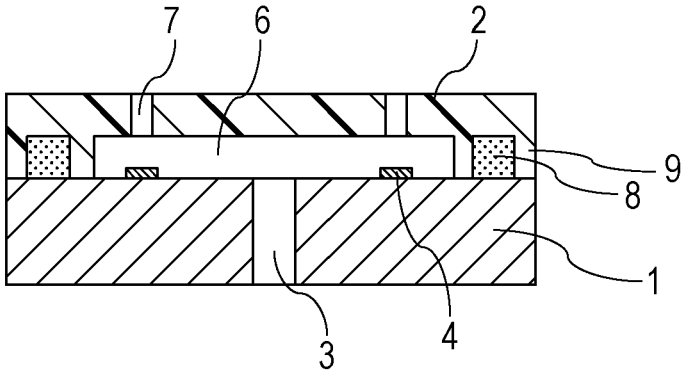
FIGS. 2A to 2C are diagrams illustrating an example of a liquid ejection head according to an embodiment of the present invention.
Figure 2B:
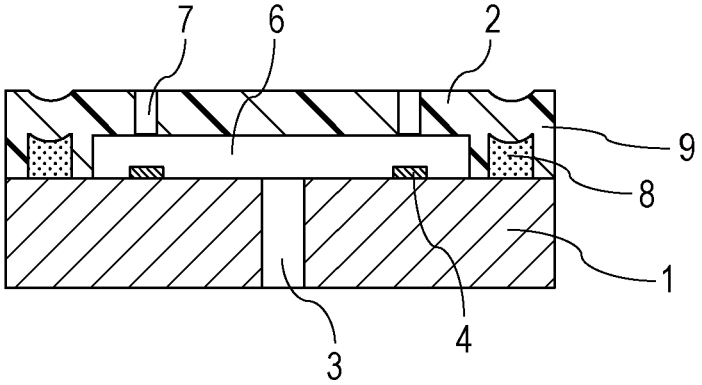
Figure 2C:
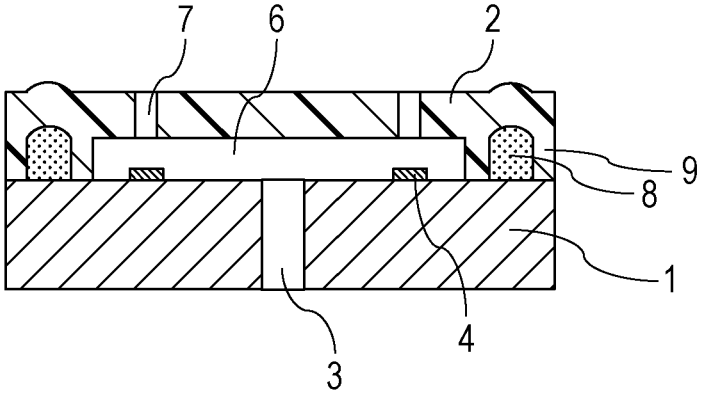

FIGS. 2A to 2C are diagrams illustrating an example of the cross section of the liquid ejection head shown in FIG. 1, taken along the line II-II. FIGS. 2A to 2C are cross-sectional views of different liquid ejection heads.

As shown in FIG. 2A, a channel wall member 2 comprising a photosensitive resin is formed on the upper surface of the substrate 1. The channel wall member 2 has a first region 8 and a second region 9 that are arranged in a direction parallel to the surface of the substrate 1. The first region 8 is a region having a lower crosslink density than the second region 9. Since the crosslink density of the first region 8 is lower than that of the second region 9, a stress applied to the substrate 1 by the channel wall member 2 is reduced. The mechanical strength of the channel wall member 2 becomes higher in the case where the first region 8 is provided compared with the case where the portion in which the first region 8 is to be formed is left hollow. As a result, the channel wall member 2 becomes less likely to be removed from the substrate 1 even when a stress is applied to the substrate 1.

The first region and the second region are arranged in a direction parallel to the surface of the substrate. This reduces the stress applied to the substrate 1 by a sufficient degree. The expression "arranged in a direction parallel to the surface of the substrate" means that both the first region and the second region are present on a plane parallel to the surface of the substrate. It is preferable that a half or more the first region overlaps the second region in a direction perpendicular to the surface of the substrate. The first region and the second region are two regions in the channel wall member each having a uniform crosslink density. Thus, the crosslink density is uniform in the first region. The crosslink density is uniform in the second region. Note that, the first region 8 has a lower crosslink density than the second region 9. As for the expression "the crosslink density is uniform", when different portions of the same photosensitive material are exposed to light under the same conditions, the crosslink density of each portion is considered to be uniform. Errors such as manufacturing errors are ignored.

In the case where the first region 8 has a lower crosslink density than the second region 9, differences in heat shrinkage, the Young's modulus, hardness, adhesion, tensile stress, and the like between the first region 8 and the second region 9 arise. This may cause a change in the shape of the surface of the channel wall member, that is, the shape of the ejection port-plane in which liquid ejection ports 7 are formed, as shown in FIGS. 2B and 2C. The shape of the surface of the ejection port-plane depends on the positions of the first region and the second region and the shape of the pattern of the first region and the second region; the ejection port-plane may bow upward or may bow downward. Both deformations may coexist in the same liquid ejection head. The shape of the surface of the ejection port-plane can be observed using a metallurgical microscope, an optical interference profilometer, a scanning probe microscope, an electron microscope, or the like.

Thus, on the basis of the shape of the surface of the ejection port-plane, formation of the first region 8 and the second region 9 in the channel wall member 2 can be estimated. Even in the case where the shape of the surface of the ejection port-plane is substantially uniform, formation of the first region 8 and the second region 9 on the channel wall member 2 can be estimated by irradiating the ejection port-plane with an electromagnetic wave, a sound wave, or the like that has a different absorption property and a different reflection property with respect to the first region 8 and the second region 9, and then analyzing the response. A method in which the first region 8 and the second region 9 comprise different materials having different colors may also be employed. This method makes it easy to observe the surface of the ejection port-plane. In addition, the colors of the first region 8 and the second region 9 may be used for controlling the alignment, widths, thicknesses, and the like of the first region 8 and the second region 9.

In the case where the first region 8 has a lower crosslink density than the second region 9, one or more properties of the Young's modulus, hardness, adhesion, and tensile stress of the first region 8 is likely to be lower than those of the second region 9. The Young's modulus is the ratio of stress to strain. The smaller the Young's modulus, the smaller the stress. The Young's modulus of the first region 8 is preferably 90% or less of that of the second region 9. In many cases, the lower the crosslink density, the lower the hardness. The hardness of the first region 8 is preferably lower than that of the second region 9. The term "adhesion" used herein refers to the adhesion between each region of the channel wall member and the substrate. A low crosslink density may lead to a reduction in adhesion. In both of the second region and the first region, the higher the adhesion, the higher the reliability of the liquid ejection head.

Figure 3A:
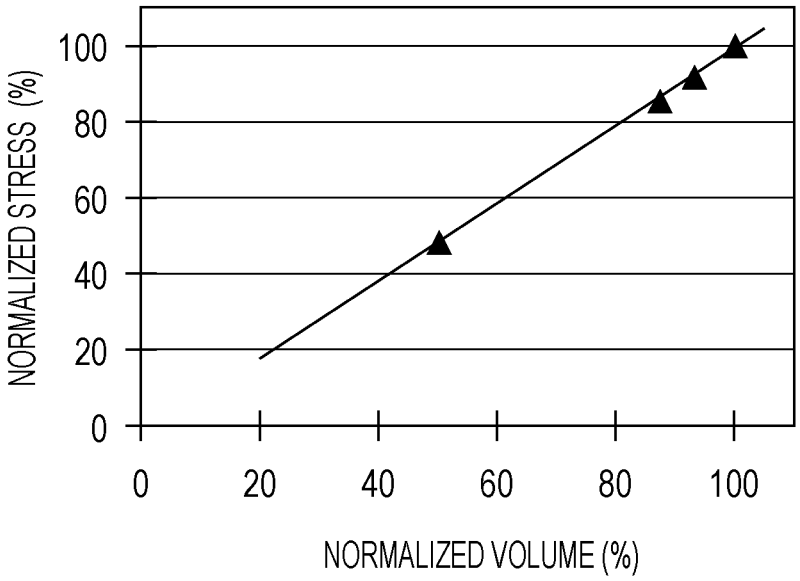
FIGS. 3A to 3C are graphs related to a liquid ejection head according to an embodiment of the present invention.

FIG. 3A is a graph showing the relationship between the proportion of the second region and the tensile stress applied to the substrate 1. FIG. 3A shows a change in the warpage of a silicon substrate which occurred while a channel wall member was formed on the surface of the substrate using a photosensitive resin that was a negative photosensitive resin including an epoxy resin. The horizontal axis of the graph shows the normalized volume fraction of the second region. The vertical axis of the graph shows the normalized stress. As shown in FIG. 3A, the lower the normalized volume, that is, the higher the proportion of the first region having a lower crosslink density, the lower the stress applied to the substrate.

Figure 3B:
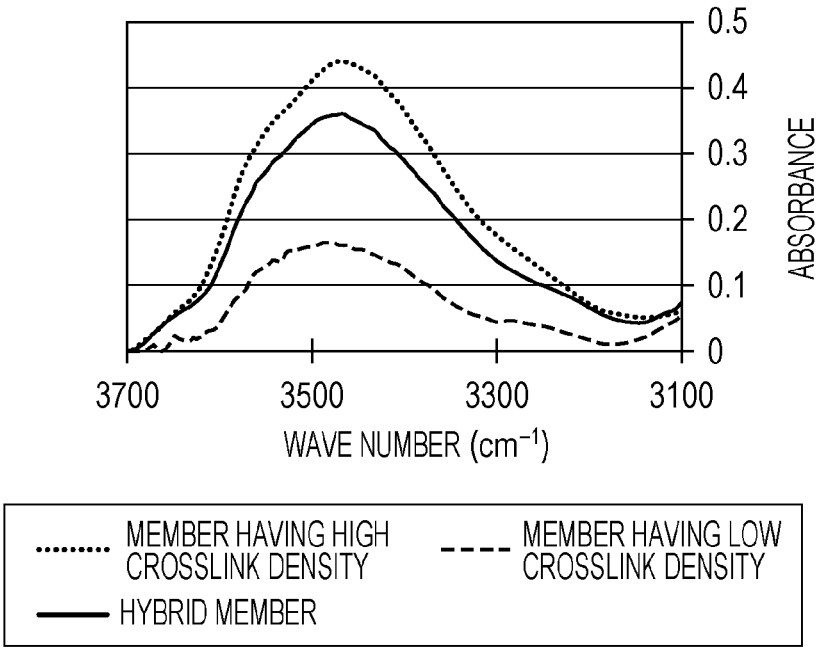
Figure 3C:
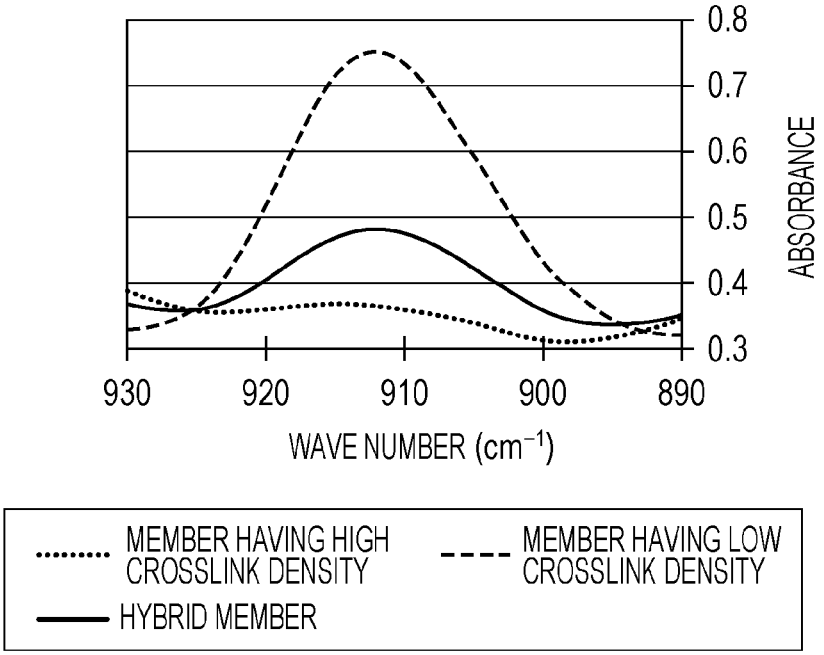

FIGS. 3B and 3C are infrared absorption spectra showing the crosslink density of one of the epoxy resins used in the present invention. As crosslinking of the epoxy resin proceeds, the peak absorbance corresponding to OH groups at 3,700 to 3,100 $cm^{-1}$ is increased and the peak absorbance corresponding to epoxy rings at 930 to 890 $cm^{-1}$ is reduced. Thus, the degree of crosslink density can be relatively determined using, for example, an infrared absorption spectrum as described above.

The degree of crosslink density may also be relatively determined by Raman spectroscopy, nuclear magnetic resonance, X-ray diffractometry, a photoacoustic analysis, time-of-flight mass spectrometry, X-ray photoelectron spectroscopy, X-ray absorption spectroscopy, a thermal analysis, a hardness measurement, or a nanoindentation technique. Alternatively, a difference in crosslink density may be determined on the basis of the state of chemical bonding or molecular shape by measuring viscoelasticity, Young's modulus, solubility, or the like.

The lower the crosslink density of the first region, the greater the stress reduction effect. In order to effectively produce the stress reduction effect, the ratio of the crosslink density of the first region to that of the second region is preferably higher than 0% and 90% or less. Since a reduction in crosslink density results in a reduction in the stress applied to the substrate, the ratio of the crosslink density of the first region to that of the second region is more preferably 70% or less. The ratio of the crosslink density of the first region to that of the second region is further preferably 50% or less because disconnection of the three-dimensional network of a bridge structure increases the stress reduction effect. Note that, the state where "the ratio of the crosslink density of the first region to that of the second region is 0%" refers to a state where no crosslink is formed in the first region. In the case where a photosensitive resin is used as in this embodiment, it is difficult to form the first region while setting the ratio to exactly 0% due to an environmental influence on the photosensitive resin. However, it is still possible to make this ratio close to 0%. In this case, a resin that does not cause crosslinking when being irradiated with an electromagnetic wave, a radiation, or the like that are generated in the manufacturing environment or the operating environment, that does not cause crosslinking in air or the atmosphere of the manufacturing process, and that does not cause crosslinking due to heat generated during the manufacturing process or operation of the product may be employed. On the other hand, according to the embodiment, good selectivity of materials, a high degree of flexibility in the manufacturing process, a short manufacturing process, a little limitation to the operation environment of the liquid ejection head, and the like may be realized.

A case where the channel wall member has the first region and the second region is described below. As described above, the crosslink density in the first region is uniform, and the crosslink density in the second region is also uniform. The ratio of the volume of the first region to the total volume of the first region and the second region is preferably 10% or more and 90% or less in order to achieve the stress reduction while keeping a skeleton capable of maintaining an adequate strength. The volume fraction of the first region is more preferably 70% or less in order to enhance a strength to an external force. The volume fraction of the first region is further preferably 50% or less in order to enhance the durability of the first region when the first region is brought into contact with a liquid by covering the first region with the second region.

The channel wall member is in direct contact with the surface of the substrate or in contact with the surface of the substrate via a layer formed on the surface of the substrate. The ratio of the area of the surface of the first region at which the first region is in contact with the surface of the substrate to the area of the surface of the channel wall member at which the channel wall member is in contact with the surface of the substrate is preferably 0% or more and 90% or less from the viewpoint of the adhesion between the channel wall member and the substrate.

The channel wall member comprises a photosensitive resin. The photosensitive resin may be a negative photosensitive resin. Considering the degree of the flexibility of the manufacturing process and the reliability of the product, the photosensitive resin is preferably a resin having high resistance to heat and chemicals, that is, specifically, at least one of a polyimide resin, a polyamide resin, an epoxy resin, a polycarbonate resin, and a fluororesin. In particular, among these photosensitive resins, an epoxy resin is preferably used.

Using the same material for forming the first region and the second region simplifies the manufacturing process since the number of types of materials used is reduced. The photosensitive resin may include a photoacid generating agent, a sensitizing agent, a reducing agent, an adhesion-enhancing adhesive, a water repellent, an electromagnetic wave-absorbing member, and the like. The photosensitive resin may also include a thermoplastic resin, a softening point-controlling resin, a resin for increasing strength, and the like. The photosensitive resin may also include an inorganic filler, carbon nanotube, and the like. The photosensitive resin may also include a conductive material in order to take measures against static electricity. The above-described components may be added to the photosensitive resin in order to control the crosslink density.

Figure 4A:
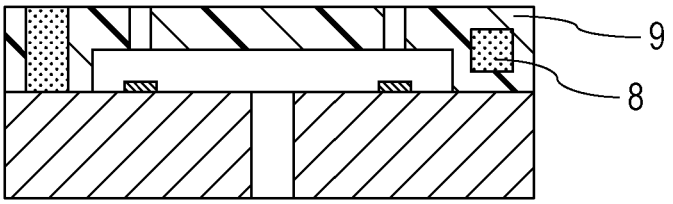
FIGS. 4A to 4D are diagrams illustrating an example of a liquid ejection head according to an embodiment of the present invention.

Examples of the first region 8 and the second region 9 formed in the channel wall member are shown in FIGS. 4A to 4D. The first region 8 can be disposed at various positions. For example, in FIG. 4A, the shape and position of the first region are asymmetrical with respect to the channel. In FIG. 4A, on the left side of the channel, the first region is disposed so as to be in contact with outside air. The first region may also be disposed so as to be in contact with a liquid, that is, so as to be exposed to the channel. However, the first region may be dissolved in the liquid due to its low crosslink density. Considering this, the first region is preferably disposed so as not to be brought into contact with a liquid.

The reliability of the liquid ejection head may be further enhanced by covering the first region with the second region, the substrate, or another member. In the case where the adhesion between the first region and the substrate is poor, the second region may be interposed between the first region and the substrate in order to enhance the adhesion. On the right side of the channel in FIG. 4A, the second region is interposed between the first region and the substrate. On the other hand, the first region may be disposed so as to be in contact with a liquid in order to serve as an identification pattern for monitoring degradation of the liquid ejection head.

Figure 4B:
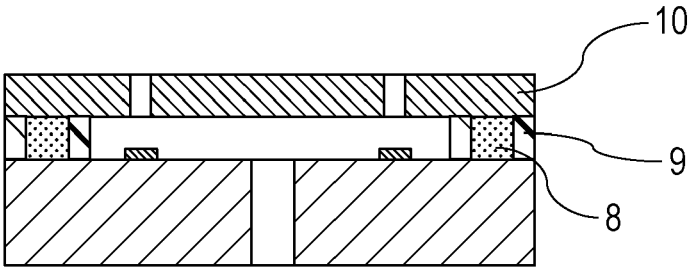
Figure 4C:
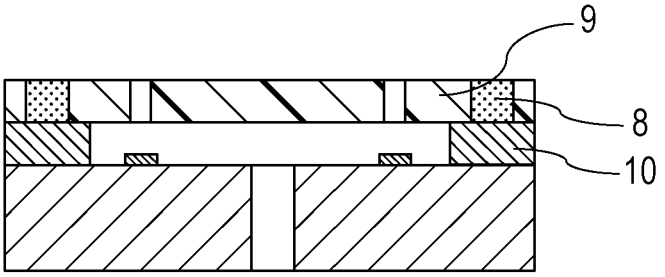

The channel wall member may have a third region 10 in addition to the first region 8 and the second region 9. As shown in FIGS. 4B and 4C, the channel wall member may have the first region 8, the second region 9, and the third region 10. The third region 10 has a crosslink density different from those of the first region 8 and the second region 9. In FIGS. 4B and 4C, examples of a liquid ejection head in which the third regions comprises a material different from the materials of the first region 8 and the second region 9. The third region 10 comprises an organic material or an inorganic material. Examples of the materials of the third region 10 include a carbide, an oxide, a nitride, a metal, and a mixture of these materials. Using the same material for forming the first region 8, the second region 9, and the third region 10 simplifies the manufacturing process. The third region 10 may be composed of a positive or negative photosensitive resin, a thermal-crosslinkable resin, a thermoplastic resin, or a mixture of these resins. In particular, the third region 10 is preferably composed of a negative photosensitive resin. As shown in FIGS. 4B and 4C, the first region and the second region are arranged in a direction parallel to the surface of the substrate. Therefore, it is possible to separately form the first region and the second region by changing exposure conditions. This further simplifies the manufacturing process. In addition, this enhances the accuracy of the positions of the first region and the second region compared with the case where the first region and the second region are stacked on top of another.

Figure 4D:
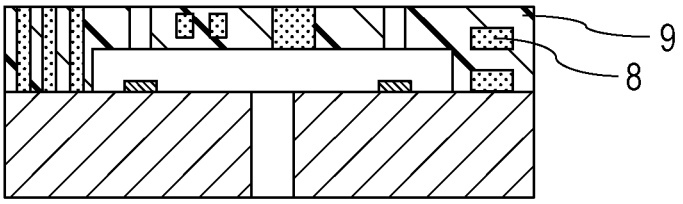

As shown in FIG. 4D, the patterns of the first region and second region are not limited and may be patterns that are combinations of a circle, a triangle, a quadrangle, a trapezoid, a hexagon, other polygons, a straight line, a curve, and the like viewed from the plane on which the third region is formed or the cross section of the liquid ejection head. The first region and second region may be horizontally arranged or may be stacked on top of one another. Alternatively, for example, the first region and second region may be horizontally arranged and stacked on top of one another to form a network structure.

The channel wall member include a water-repellent film, a hydrophilic film, a protection film, or the like formed thereon. The channel wall member may have a relief structure, a vesicular structure, or the like. The channel wall member may have a ditch or a hole formed therein in order to further reduce the stress applied to the substrate. The channel wall member may be constituted by an inorganic member that covers the channel and a resin member that fills spaces. In this case, by applying the structure according to the embodiment to the portions in which the resin member is used, the stress caused in the resin member may be reduced, which increases the strength of the channel wall member while reducing the damage to the inorganic member. An adhesion-improving layer or a planarization layer may be interposed between the substrate and the channel wall member.

The liquid ejection head according to the embodiment may be used for producing a liquid ejection system. The liquid ejection system herein refers to apparatuses such as a printer, a copying machine, a facsimile including a communication system, a word processor and a portable device that include a printer unit, and industrial equipment formed by combining these processing devices. The object onto which a liquid is ejected may have a two-dimensional structure or a three-dimensional structure. A liquid may be ejected toward a space. The above-described liquid ejection system may be used in a semiconductor manufacturing system or a medical system.

A method for manufacturing the liquid ejection head according to the embodiment is described below with reference to FIGS. 5A to 5E. FIGS. 5A to 5E are cross-sectional views taken at the same position as in FIGS. 2A to 2C.

Figure 5A:
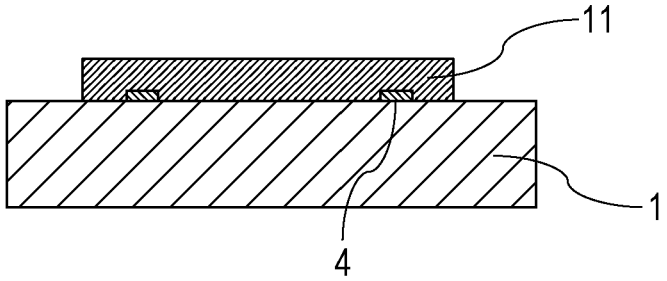
FIGS. 5A to 5E are diagrams illustrating an example of a method for manufacturing a liquid ejection head according to an embodiment of the present invention.

As shown in FIG. 5A, a substrate 1 including energy generating devices 4 and a mold 11 for forming a channel that are formed on the surface thereof is prepared. The mold 11 for forming a channel comprises a resin or a metal and is preferably composed of a negative photosensitive resin or a positive photosensitive resin. In particular, the mold 11 is preferably composed of a positive photosensitive resin. The mold 11 is formed by applying the above-described material to the surface of the substrate 1 and subsequently patterning the resulting film by photolithography or the like.

Figure 5B:
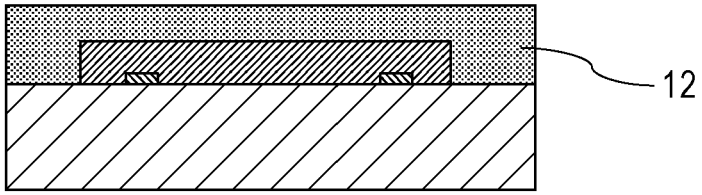

As shown in FIG. 5B, a coating layer 12 is formed so as to cover the mold 11. The coating layer 12, which serves as a channel wall member in the subsequent step, comprises a photosensitive resin. The coating layer 12 is formed by spin coating, slit coating, spray coating, dry-film lamination, or the like.

Figure 5C:
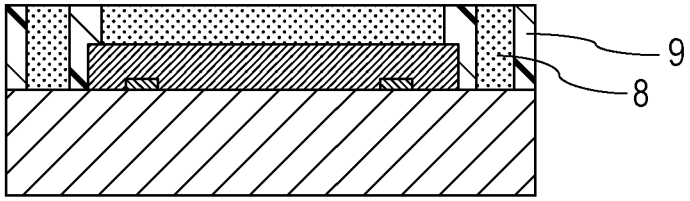

As shown in FIG. 5C, the first region 8 and the second region 9 are formed in the coating layer 12 so as to be arranged in a direction parallel to the surface of the substrate 1. For example, in the case where the coating layer 12 comprises a negative photosensitive resin, the first region 8 is not exposed to light and the second region 9 is exposed to light. Subsequently, the entire coating layer 12 is heated (post-exposure bake, PEB). In this manner, the crosslink density of the first region 8 is set lower than that of the second region 9. Generally, the stress applied to the substrate varies greatly during a heating step. When the first region 8 and the second region 9 are formed by changing exposure conditions, a portion that has not been exposed to light may be used as the first region 8 that has a low crosslink density. In this case, the first region 8, which is an unexposed portion, exhibits fluidity during the heating step, which markedly reduces the stress applied to the substrate. In another case, the stress applied to the substrate may be relieved due to the fluidity of the first region 8.

Figure 5D:
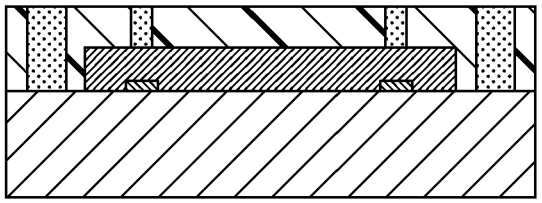

As shown in FIG. 5D, regions in which liquid ejection ports are to be formed are created in the coating layer 12 by photolithography or the like. The regions may be created simultaneously with the first region 8 and the second region 9. However, in the liquid ejection head shown in FIGS. 5A to 5E, these regions are preferably created separately in order to prevent the first region 8 from being developed and lost during the development of the liquid ejection ports. Creating these regions separately makes it easier to differentiate between the exposure doses of the first region 8 and the regions in which the liquid ejection ports are to be formed. This makes it easier to make the first region 8 remain during the development of the liquid ejection ports.

Figure 5E:
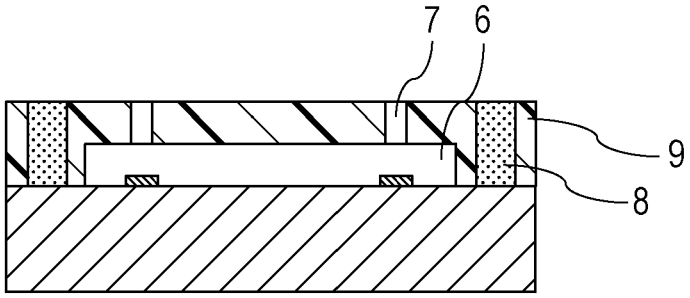

As shown in FIG. 5E, development was performed using an organic solvent, and the liquid flow passage 6 and the liquid ejection ports 7 are formed. Subsequently, the channel wall member is subjected to a heat treatment to be cured. The heat treatment enhances the reliability of the liquid ejection head. The heat treatment may be performed, for example, using an oven or a hot plate or by rapid thermal annealing (RTA). The heat treatment may be performed in air, an oxygen atmosphere, a nitrogen atmosphere, an argon atmosphere, a hydrogen atmosphere, a water vapor atmosphere, a carbon dioxide atmosphere, a helium atmosphere, a mixed gas atmosphere of these gases, or the like. The heat treatment may be performed in vacuum or under pressure. The heat treatment step is also one of the steps in which the stress applied to the substrate varies greatly. Through the heat treatment step, the crosslink densities of the first region and the second region may be increased. Addition of a thermosetting catalyst makes the increase in cross densities significant.

As needed, a supply port may be formed in the substrate 1. The timing at which a step for forming the supply port is conducted is not limited. For example, the supply port may be formed before or after a step for forming the energy generating devices or before or after a step for forming the channel wall member. The supply port may be formed by, for example, wet etching, dry etching, or laser processing.

The liquid ejection head is manufactured as described above. The liquid ejection head includes a channel wall member having a first region 8 and a second region 9 that are arranged in a direction parallel to the surface of a substrate 1. The crosslink density of the first region 8 is lower than that of the second region 9.

Another method for manufacturing the liquid ejection head is described below with reference to FIGS. 6A to 6C, which are cross-sectional views taken at the same position as in FIGS. 2A to 2C.

Figure 6A:
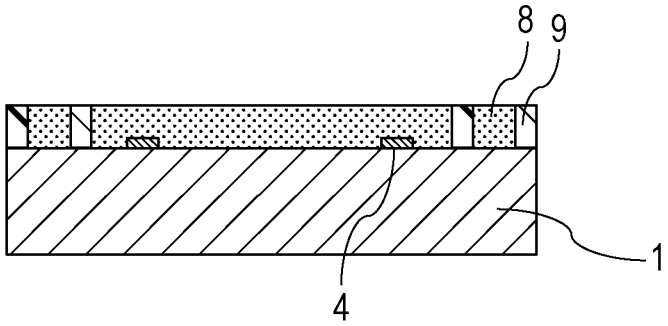
FIGS. 6A to 6C are diagrams illustrating an example of a method for manufacturing a liquid ejection head according to an embodiment of the present invention.

As shown in FIG. 6A, a substrate 1 including energy generating devices 4 formed on the upper surface thereof is prepared. The energy generating devices 4 are covered with a layer (first layer) comprising a photosensitive resin. The first layer has a first region 8 and a second region 9 that are arranged in a direction parallel to the surface of the substrate 1. The first layer comprises a negative photosensitive resin or the like. A portion of the negative photosensitive resin which is exposed to light serves the second region 9, and a portion of the negative photosensitive resin which is not exposed to light serves as the first region 8. Consequently, the crosslink density of the first region 8 becomes lower than that of the second region 9. In the subsequent step, the first layer serves as a channel wall member.

Figure 6B:
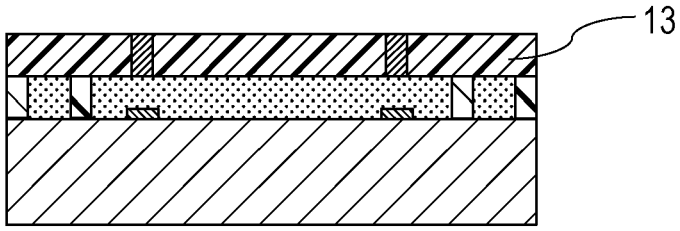

As shown in FIG. 6B, a second layer 13 is formed on the first layer. The second layer 13 comprises a photosensitive resin, an inorganic film, or the like. In the second layer 13, regions in which liquid ejection ports are to be formed are created. In the case where the second layer 13 is an inorganic film, the liquid ejection ports may be formed in the second layer 13 using physical machining such as wet etching, dry etching, or a laser and chemical machining in a combined manner.

Figure 6C:
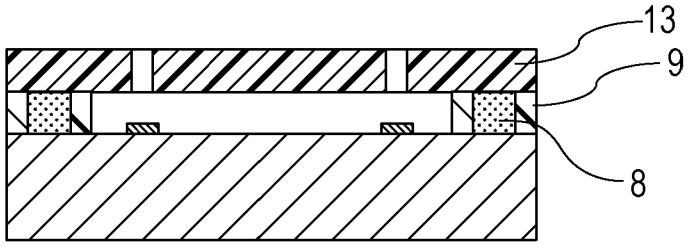

Development is performed, and the liquid ejection head shown in FIG. 6C is manufactured. In the above-described method, a mold for forming a channel is not formed. In the liquid ejection head manufactured by the above-described method, the upper surface of the first region 8 is covered with the second layer 13, which enhances the reliability of the liquid ejection head.

Another method for manufacturing a liquid ejection head in which the first region and the second region are created at positions distant from the substrate is described below with reference to FIGS. 7A to 7D, which are cross-sectional views taken at the same position as in FIGS. 2A to 2C.

Figure 7A:
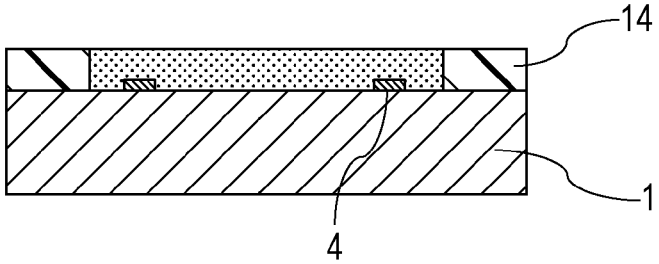
FIGS. 7A to 7D are diagrams illustrating an example of a method for manufacturing a liquid ejection head according to an embodiment of the present invention.

As shown in FIG. 7A, a substrate 1 including energy generating devices 4 formed on the upper surface thereof is prepared. The energy generating devices 4 are covered with a first photosensitive resin layer 14. The first photosensitive resin layer 14 has been exposed to light so that a latent image is formed in a portion of the first photosensitive resin layer 14.

Figure 7B:
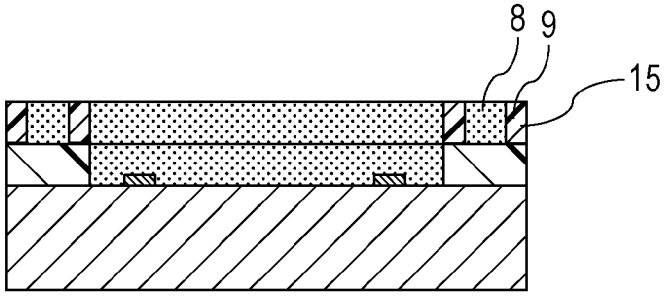

As shown in FIG. 7B, a second photosensitive resin layer 15 is formed on the first photosensitive resin layer 14. The second photosensitive resin layer 15 comprises a negative photosensitive resin or the like. A portion of the negative photosensitive resin which is exposed to light serves as a second region 9. A portion of the negative photosensitive resin which is not exposed to light serves as a first region 8. A portion of the second photosensitive resin layer in which a channel through which a liquid flows is to be formed is not also be exposed to light. Alternatively, the first region 8 and the second region 9 may be created by changing exposure dose. For example, a region of the negative photosensitive resin in which the exposure dose per volume is high may be used as the second region 9, and a region of the negative photosensitive resin in which the exposure dose per volume is low may be used as the first region 8.

Figure 7C:
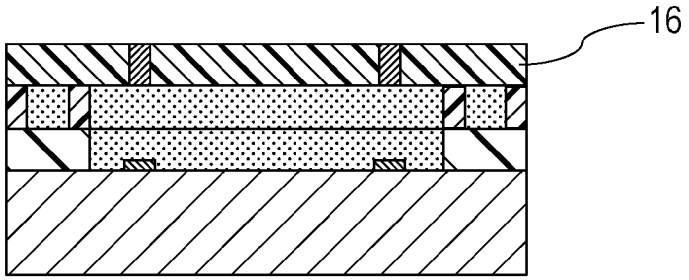

As shown in FIG. 7C, an ejection port formation layer 16 is formed on the second photosensitive resin layer 15. Regions in which liquid ejection ports are to be formed are created in the ejection port formation layer 16. The ejection port formation layer 16 comprises a photosensitive resin, an inorganic film, or the like.

Figure 7D:
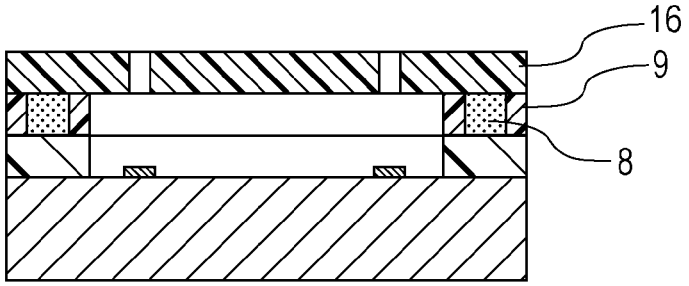

Development is performed, and the liquid ejection head shown in FIG. 7D is manufactured. In the liquid ejection head, the first region 8 and the second region 9 are disposed at positions distant from the substrate 1.

Figure 8A:
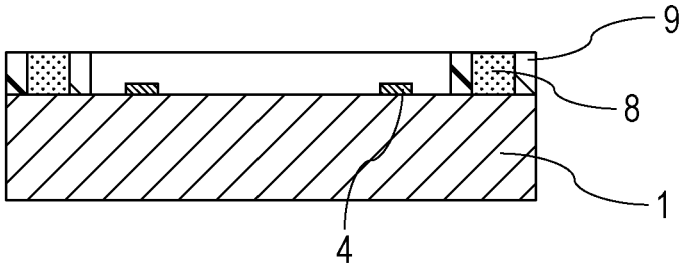
FIGS. 8A and 8B are diagrams illustrating an example of a method for manufacturing a liquid ejection head according to an embodiment of the present invention.
Figure 8B:
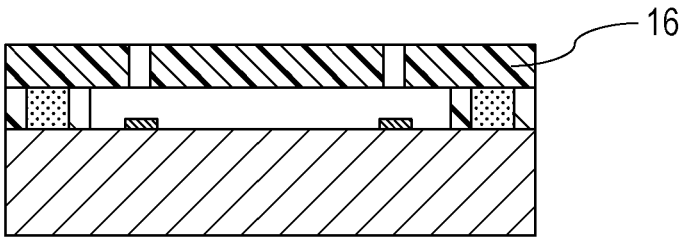

The liquid ejection head according to the embodiment may also be manufactured by another method in which, as shown in FIGS. 8A and 8B, a layer having a first region 8 and a second region 9 is formed by patterning and subsequently an ejection port formation layer 16 is attached onto the layer. FIGS. 8A and 8B are cross-sectional views taken at the same position as in FIGS. 2A to 2C.

In addition, for example, a method shown in FIGS. 9A to 9E may also be employed. FIGS. 9A to 9E are cross-sectional views taken at the same position as in FIGS. 2A to 2C.

Figure 9A:
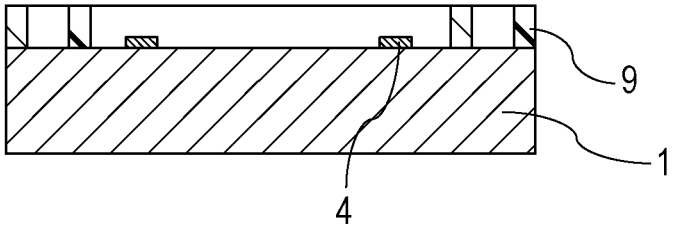
FIGS. 9A to 9E are diagrams illustrating an example of a method for manufacturing a liquid ejection head according to an embodiment of the present invention.

As shown in FIG. 9A, a second region 9 is formed on the substrate 1. The second region 9 is formed by, for example, exposing a negative photosensitive resin to light and removing a portion that has not been exposed to light.

Figure 9B:
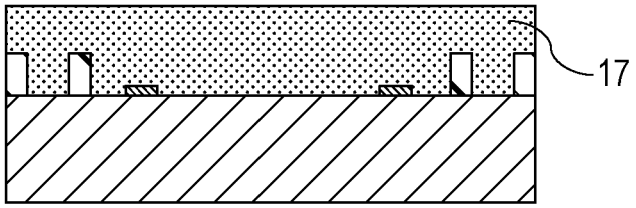

As shown in FIG. 9B, a negative photosensitive resin 17 is applied to the substrate 1 and the second region 9 so as to fill spaces in which the second region 9 is not formed with the negative photosensitive resin 17. The portions filled with the negative photosensitive resin 17 serve as a first region 8.

Figure 9C:
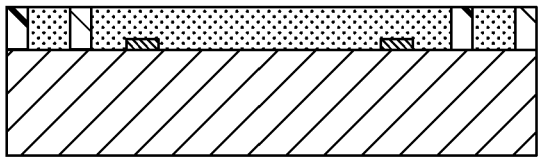

As shown in FIG. 9C, the surface of the negative photosensitive resin 17 is ground by chemical mechanical polishing (CMP) or the like so as to be planarized.

Figure 9D:
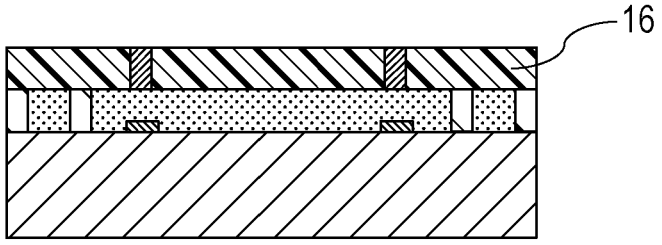
Figure 9E:
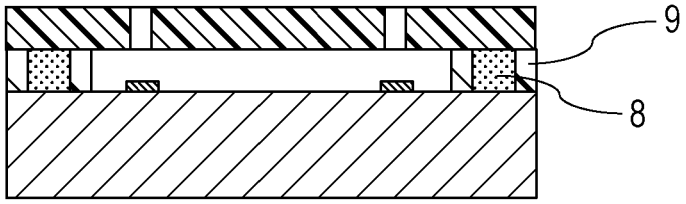

As shown in FIG. 9D, an ejection port formation layer 16 is formed on the negative photosensitive resin 17. Then, development is performed. Thus, the liquid ejection head shown in FIG. 9E is manufactured.

The methods described with reference to FIGS. 5A to 8B are advantageous in that the first region 8 and the second region 9 can be formed in a single step. The method described with reference to FIGS. 9A to 9E is advantageous in that a layer having the first region 8 and the second region 9 can be further planarized compared with the methods described with reference to FIGS. 5A to 8B.

The crosslink densities of the first region 8 and the second region 9 may be further increased by, for example, exposing the first region 8 and the second region to light or performing a heat treatment of the first region 8 and the second region. This further enhances the reliability of the liquid ejection head.

In consideration of the manufacturing process, a region having a relatively low crosslink density may be created in a member other than the channel wall member. For example, the edges of the negative photosensitive resin viewed in a direction parallel to the surface of the substrate serve as regions having a relatively low crosslink density, and the other region of the negative photosensitive resin serves as a region having a relatively high crosslink density. The regions having a relatively low crosslink density are finally removed. In this method, the warpage of the substrate that occurs during the manufacturing process may be reduced.

EXAMPLES

The present invention is specifically described with reference to examples below.

Example 1

As shown in FIG. 5A, a substrate 1 including energy generating devices 4 comprising TaSiN and a mold 11 for forming a channel, which were formed on the upper surface thereof, was prepared. The substrate 1 was a silicon substrate. The mold 11 for forming a channel was formed by applying a positive photosensitive resin ("ODUR1010" produced by TOKYO OHKA KOGYO CO., LTD) to the surface of the substrate 1, exposing the resulting film to light using a stepper ("FPA-3000i5+" produced by CANON KABUSHIKI KAISHA), and performing development.

As shown in FIG. 5B, a coating layer 12 was formed so as to cover the mold 11. The coating layer 12 was formed by applying a negative photosensitive resin ("EHPE-3150" produced by Daicel Corporation) by spin coating and then performing back rinsing and side rinsing. The coating layer 12 was baked using a hot plate, and the surface of the coating layer 12 was subjected to a press work to be planarized. A fluororesin was applied to the surface of the coating layer 12 by slit coating, and the resulting film was baked at 60° C. using a hot plate.

As shown in FIG. 5C, the coating layer 12 was exposed to light with a mask using a stepper ("FPA-3000i5+" produced by CANON KABUSHIKI KAISHA). Thus, an exposed portion and an unexposed portion were formed. The exposed portion of the coating layer 12, which had been exposed to light, served as a second region 9. The unexposed portion of the coating layer 12, which had not been exposed to light, served as a first region 8.

As shown in FIG. 5D, regions in which liquid ejection ports were to be formed were created in the coating layer 12. The region of the coating layer 12 which was not exposed to light in the step shown in FIG. 5C was exposed to light so as to form a pattern thereon. A part of the region which was not exposed to light again, that is, a part of the region which was not exposed to light in the two exposure steps, was used as a region in which liquid ejection ports were to be formed. In the latter exposure, the exposure dose was set to about 80% of that of the former exposure of the coating layer 12.

As shown in FIG. 5E, development was performed using a liquid mixture of methyl isobutyl ketone (MIBK) and xylene. Thus, a liquid flow passage 6 and liquid ejection ports 7 were formed. Then, baking was performed at 120° C. using a hot plate.

The substrate 1 was etched by reactive ion etching to form a liquid supply port in the substrate 1. Then, a heat treatment was performed at 160° C. using an oven in a nitrogen atmosphere. Thus, a liquid ejection head was prepared.

The ratio of the crosslink density of the first region 8 to that of the second region 9, which was calculated from the amount of epoxy groups remaining in each region on the basis of infrared absorption spectra of the first region 8 and the second region 9 of the liquid ejection head, was 90%. The Young's moduli of the first region 8 and the second region 9 at 25° C. were measured using a nanoindenter. The ratio of the Young's modulus of first region 8 to that of the second region 9 was 90%. The ratio of the area of the surface of the first region 8 at which the first region 8 was in contact with the substrate 1 to the area of the surface of the channel wall member at which the channel wall member was in contact with the substrate 1 was 80%. The ratio of the volume of the first region to the total volume of the first region and the second region was 90%. The liquid ejection head was immersed in an ink ("BCI-7C" produced by CANON KABUSHIKI KAISHA) for 48 hours and subsequently observed using a metallurgical microscope in order to examine whether the channel wall member was removed from the substrate or not. The removal of the channel wall member was not observed.

Example 2

As shown in FIG. 6A, a substrate 1 including energy generating devices 4 comprising TaSiN, which were formed on the upper surface thereof, was prepared. The substrate 1 was a silicon substrate. The energy generating devices 4 were covered with a first layer having a first region 8 and a second region 9 that were arranged in a direction parallel to the surface of the substrate 1.

The first layer was formed as described below. A PET film including a dry film mainly comprising a negative photosensitive resin ("157S70" produced by Japan Epoxy Resin Co., Ltd), which was laminated on the PET film, was prepared. The PET film was laminated on the substrate 1 using a roll laminator. Subsequently, the PET film was peeled off, and the resulting substrate 1 was cleaned with pure water. The first layer was exposed to light so as to form a pattern thereon and baked at 50° C. using a hot plate. The region that had been exposed to light served as a second region 9, and the region that had not been exposed to light served as a first region 8.

As shown in FIG. 6B, a second layer 13 was formed on the first layer. The second layer 13 was formed using a dry film mainly comprising a negative photosensitive resin ("157S70" produced by Japan Epoxy Resin Co., Ltd) as in the formation of the first layer, except that the type of the photopolymerization initiator added to the second layer 13 was different from that added to the first layer. The second layer 13 was then exposed to light so as to form a pattern thereon. Thus, regions in which liquid ejection ports were to be formed were created on the second layer 13. The exposure dose of the second layer was 50% of that of the first layer.

Developed was performed using propylene glycol methyl ether acetate (PGMEA). A heat treatment was performed using a hot plate at 180° C. in air. Thus, the liquid ejection head shown in FIG. 6C was prepared.

The liquid ejection head was subjected to a measurement as in Example 1. The ratio of the crosslink density of the first region 8 to that of the second region 9 was 70%. The ratio of the Young's modulus of the first region 8 to that of the second region 9 was 70%. The ratio of the area of the surface of the first region 8 at which the first region 8 was in contact with the substrate 1 to the area of the surface of the channel wall member at which the channel wall member was in contact with the substrate 1 was 70%. The ratio of the volume of the first region to the total volume of the first region and the second region was 50%. The liquid ejection head was observed as in Example 1 in order to examine whether the channel wall member was removed from the substrate or not. The removal of the channel wall member was not observed.

Example 3

As shown in FIG. 7A, a substrate 1 including energy generating devices 4 comprising TaSiN, which were formed on the upper surface thereof, was prepared. The substrate 1 was a silicon substrate. The energy generating devices 4 were covered with a first photosensitive resin layer 14 comprising a negative photosensitive resin. The first photosensitive resin layer was formed by laminating a dry film comprising a negative photosensitive resin ("EPON SU-8" produced by Shell Chemicals) on the substrate using a roll laminator and then removing a film comprising a fluororesin, which was a support of the dry film. The first photosensitive resin layer 14 was exposed to light to form a latent image on a portion of the first photosensitive resin layer 14.

As shown in FIG. 7B, a second photosensitive resin layer 15 was formed on the first photosensitive resin layer 14. The second photosensitive resin layer 15 was formed as in the formation of the first photosensitive resin layer 14 using the same material, except that the type of the photopolymerization initiator added to the second photosensitive resin layer 15 was different from that added to the first photosensitive resin layer 14. Subsequently, the second photosensitive resin layer 15 was exposed to light to form a pattern thereon. The portion of the second photosensitive resin layer 15 which was exposed to light served as a second region 9. The portion of the second photosensitive resin layer 15 which was not exposed to light served as a first region 8.

As shown in FIG. 7C, an ejection port formation layer 16 was formed on the second photosensitive resin layer 15. The ejection port formation layer 16 was formed as in the formation of the first photosensitive resin layer 14 using a dry film mainly comprising a negative photosensitive resin ("157S70" produced by Japan Epoxy Resin Co., Ltd). The ejection port formation layer 16 was exposed to light to create regions in which liquid ejection ports were to be formed.

Development was performed using propylene glycol methyl ether acetate (PGMEA). A heat treatment was performed using a hot plate at 200° C. in a nitrogen atmosphere. Thus, the liquid ejection head shown in FIG. 7D was prepared.

The liquid ejection head was subjected to a measurement as in Example 1. The ratio of the crosslink density of the first region 8 to that of the second region 9 was 30%. The ratio of the Young's modulus of the first region 8 to that of the second region 9 was 20%. The ratio of the area of the surface of the first region 8 at which the first region 8 was in contact with the substrate 1 to the area of the surface of the channel wall member at which the channel wall member was in contact with the substrate 1 was 0%. That is, the first region 8 was not in contact with the substrate 1. The ratio of the volume of the first region to the total volume of the first region and the second region was 30%. The liquid ejection head was observed as in Example 1 in order to examine whether the channel wall member was removed from the substrate or not. The removal of the channel wall member was not observed.

Example 4

As shown in FIG. 8A, a substrate 1 including energy generating devices 4 comprising TaSiN, which were formed on the upper surface thereof, was prepared. The substrate 1 was a silicon substrate. A negative photosensitive resin layer ("EHPE-3150" produced by Daicel Corporation) was laminated on the substrate 1 using a roll laminator and exposed to light to create a pattern thereon. The negative photosensitive resin layer was exposed to light using the pattern corresponding to a first region 8. Subsequently, the resulting negative photosensitive resin layer was again exposed to light using the pattern corresponding to the first region 8 and a second region 9 with an exposure dose that was one tenth of the exposure dose of the first exposure. The temperature was increased to 120° C., and subsequently development was performed. Since the first region 8 had been exposed to light at the gelation threshold or more, the first region 8 had been insolubilized at the time of development. Thus, a structure that included a negative photosensitive resin layer in which the first region 8 and the second region 9 were created and that had a space that served as a channel was formed.

An ejection port formation layer 16 was formed on the negative photosensitive resin layer. The ejection port formation layer 16 was formed as in the formation of the negative photosensitive resin layer using a dry film mainly comprising a negative photosensitive resin ("157S70" produced by Japan Epoxy Resin Co., Ltd). The ejection port formation layer 16 was exposed to light to create regions in which liquid ejection ports were to be formed.

Development was performed, and a heat treatment was performed using a hot plate at 220° C. in a nitrogen atmosphere. Thus, the liquid ejection head shown in FIG. 8B was prepared.

The liquid ejection head was subjected to a measurement as in Example 1. The ratio of the crosslink density of the first region 8 to that of the second region 9 was 40%. The ratio of the Young's modulus of the first region 8 to that of the second region 9 was 20%. The ratio of the area of the surface of the first region 8 at which the first region 8 was in contact with the substrate 1 to the area of the surface of the channel wall member at which the channel wall member was in contact with the substrate 1 was 70%. The ratio of the volume of the first region to the total volume of the first region and the second region was 70%. The liquid ejection head was observed as in Example 1 in order to examine whether the channel wall member was removed from the substrate or not. The removal of the channel wall member was not observed.

Example 5

A liquid ejection head was prepared as in Example 4 except that the volume fractions of the first region 8 and the second region 9 were changed.

The liquid ejection head was subjected to a measurement as in Example 1. The ratio of the crosslink density of the first region 8 to that of the second region 9 was 40%. The ratio of the Young's modulus of the first region 8 to that of the second region 9 was 20%. The ratio of the area of the surface of the first region 8 at which the first region 8 was in contact with the substrate 1 to the area of the surface of the channel wall member at which the channel wall member was in contact with the substrate 1 was 80%. The ratio of the volume of the first region to the total volume of the first region and the second region was 80%. The liquid ejection head was observed as in Example 1 in order to examine whether the channel wall member was removed from the substrate or not. The removal of the channel wall member was not observed.

Example 6

As shown in FIG. 9A, a substrate 1 including energy generating devices 4 comprising TaSiN, which were formed on the upper surface thereof, was prepared. The substrate 1 was a silicon substrate. A negative photosensitive resin layer ("EHPE-3150" produced by Daicel Corporation) was laminated on the substrate 1 using a roll laminator and then exposed to light. Development was performed to create a second region 9.

As shown in FIG. 9B, a negative photosensitive resin 17 mainly comprising a negative photosensitive resin ("EHPE-3150" produced by Daicel Corporation) was applied to the substrate 1 by spin coating so as to fill spaces in which the second region 9 was not formed with the negative photosensitive resin 17. The content of a photoacid generating agent in the negative photosensitive resin 17 used was lower than the content of that in the negative photosensitive resin layer used for forming the second region 9. Subsequently, baking was performed.

As shown in FIG. 9C, the negative photosensitive resin 17 was ground by chemical mechanical polishing (CMP) until the second region 9 was exposed to planarize the upper surfaces of the negative photosensitive resin 17 and the second region 9. The resulting substrate was cleaned with pure water and then baked.

As shown in FIG. 9D, an ejection port formation layer 16 was formed on the negative photosensitive resin 17, exposed to light, and heated to 120° C. Then, development was performed. Thus, the liquid ejection head shown in FIG. 9E was prepared. The ejection port formation layer 16 was formed using a dry film mainly comprising a negative photosensitive resin ("157S70" produced by Japan Epoxy Resin Co., Ltd). Then, a heat treatment was performed using a hot plate at 250° C. in vacuum. Thus, the liquid ejection head shown in FIG. 9E was prepared.

The liquid ejection head was subjected to a measurement as in Example 1. The ratio of the crosslink density of the first region 8 to that of the second region 9 was 50%. The ratio of the Young's modulus of the first region 8 to that of the second region 9 was 24%. The ratio of the area of the surface of the first region 8 at which the first region 8 was in contact with the substrate 1 to the area of the surface of the channel wall member at which the channel wall member was in contact with the substrate 1 was 30%. The ratio of the volume of the first region to the total volume of the first region and the second region was 30%. The liquid ejection head was observed as in Example 1 in order to examine whether the channel wall member was removed from the substrate or not. The removal of the channel wall member was not observed.

Comparative Example 1

A liquid ejection head was prepared as in Example 1 except for the following. In Example 1, the coating layer 12 was exposed to light so as to create the first region 8 and the second region 9 in the coating layer 12 in the step shown in FIG. 5C. However, in Comparative Example 1, the exposure of the coating layer 12 was omitted. In Comparative Example 1, the coating layer 12 was exposed to light so as to create a pattern thereon, and thereby regions in which liquid ejection ports were to be formed were created in coating layer 12.

In the liquid ejection head, the crosslink density of the coating layer (channel wall member) was uniform over the entire coating layer. The liquid ejection head was observed as in Example 1 in order to examine whether the channel wall member was removed from the substrate or not. The removal of the channel wall member was partly observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-248451, filed Nov. 29, 2013, which is hereby incorporated by reference herein in its entirety.

What is claimed is:

1. A liquid ejection head comprising:

a substrate; and a channel wall member on a surface of the substrate, the channel wall member serving as a wall of a channel through which a liquid flows, wherein the channel wall member comprises a photosensitive resin and includes a first region and a second region that are arranged in a direction parallel to the surface of the substrate, wherein the first region of the channel wall member has a lower crosslink density than the second region of the channel wall member, and wherein the first region is disposed at a position such that the first region is not exposed to the channel.

2. The liquid ejection head according to claim 1, wherein the photosensitive resin is a negative photosensitive resin.

3. The liquid ejection head according to claim 1, wherein the ratio of the crosslink density of the first region to the crosslink density of the second region is higher than 0% and 90% or less.

4. The liquid ejection head according to claim 1, wherein the ratio of the crosslink density of the first region to the crosslink density of the second region is higher than 0% and 70% or less.

5. The liquid ejection head according to claim 1, wherein the ratio of the volume of the first region to the total volume of the first region and the second region is 10% or more and 90% or less.

6. The liquid ejection head according to claim 1, wherein the ratio of the volume of the first region to the total volume of the first region and the second region is 10% or more and 70% or less.

7. The liquid ejection head according to claim 1, wherein the channel wall member is in direct contact with the surface of the substrate or in contact with the surface of the substrate via a layer formed on the surface of the substrate, and wherein the ratio of an area of a surface of the first region in contact with the surface of the substrate or the layer formed on the surface of the substrate to an area of a surface of the channel wall member in contact with the surface of the substrate or the layer formed on the surface of the substrate is 0% or more and 90% or less.

8. The liquid ejection head according to claim 1, wherein the channel wall member further includes a third region, the crosslink density of the third region being different from the crosslink densities of the first region and the second region.

9. The liquid ejection head according to claim 1, wherein the second region is a region that has been exposed to light and the first region is a region that has not been exposed to light.

10. The liquid ejection head according to claim 1, wherein an ejection port is opened in the channel wall member.

11. The liquid ejection head according to claim 10, wherein an ejection port-plane of the channel wall member in which the ejection port is opened has a part corresponding to the first region which is bowed upward or downward.

* * * * *